United States Patent [19]

Sweeney

[11] 4,435,107

[45] * Mar. 6, 1984

[54] TRAFFIC DELINEATOR

[75] Inventor: Lawrence J. Sweeney, Seneca, Pa.

[73] Assignee: Franklin Steel Company, Franklin, Pa.

[ * ] Notice: The portion of the term of this patent subsequent to Nov. 3, 1998 has been disclaimed.

[21] Appl. No.: 290,249

[22] Filed: Aug. 5, 1981

Related U.S. Application Data

[63] Continuation of Ser. No. 101,439, Dec. 10, 1979.

[51] Int. Cl.[3] ..... E01F 9/01

[52] U.S. Cl. ..... 404/10; 256/1; 256/13.1; 40/606

[58] Field of Search ..... 404/10; 52/98, 99; 403/2, 11; 256/13.1, 1; 40/606, 607; 116/63 R

[56] References Cited

U.S. PATENT DOCUMENTS

| | | | |
|---|---|---|---|
| 2,949,324 | 8/1960 | Birge | 404/10 X |
| 2,976,000 | 3/1961 | Gunderson | 404/10 X |
| 3,279,133 | 10/1966 | De Korte | 404/10 X |
| 3,371,647 | 3/1968 | Shopbell | 404/10 X |
| 3,502,007 | 3/1970 | Andersson | 404/10 |
| 3,521,917 | 7/1970 | King | 404/10 X |
| 3,698,144 | 10/1972 | Stratton | 404/10 X |
| 3,820,906 | 6/1974 | Katt | 404/10 X |
| 3,875,720 | 4/1975 | Russell | 404/10 X |
| 4,032,248 | 6/1977 | Parduhn | 404/10 |
| 4,061,435 | 12/1977 | Schmanski | 404/10 |
| 4,084,914 | 4/1978 | Humphrey | 404/10 |
| 4,092,081 | 5/1978 | Schmanski | 404/10 |
| 4,105,350 | 8/1978 | O'Donnell | 404/10 X |
| 4,106,879 | 8/1978 | Diedershagen | 404/10 |
| 4,126,403 | 11/1978 | Sweeney | 404/10 X |
| 4,245,922 | 1/1981 | Auriemma | 404/10 |
| 4,297,050 | 10/1981 | Gmelch | 404/10 |
| 4,298,292 | 11/1981 | Sweeney | 404/10 |

*Primary Examiner*—Nile C. Byers, Jr.

*Attorney, Agent, or Firm*—Fitch, Even, Tabin & Flannery

[57] ABSTRACT

The traffic delineator assembly of the present invention is comprised of a elongated resiliently flexible delineator member, an anchor post, and a rigid pilot plate. The pilot plate is attached at the upper end of the anchor post and the lower end of the flexible delineator member is attached to the pilot plate with its lower edge lying adjacent the lower edge of the pilot plate so that when the anchor post and pilot plate are driven into the ground or road surface, the bottom end of the delineator member follows the bottom edge of the pilot plate into the surface.

2 Claims, 13 Drawing Figures

TRAFFIC DELINEATOR

This application is a continuation of application Ser. No. 101,439, filed Dec. 10, 1979.

The present invention relates to delineators used to mark the edge of a roadway.

In order to improve traffic safety it has become an increasingly general practice to use delineators which extend above the roadway surface in addition to painted lines to delineate the sides of a roadway. Traffic delinators have several advantages over the mere use of painted lines. Traffic delineators may have reflective surfaces providing improved visibility especially at night or in the rain or snow. Traffic delineators also provide an audible warning to drivers who, through inattention or drowsiness may stray to the shoulder of the roadway.

A traffic delineator should have certain characteristics. Means must be provided to permanently position the traffic delineator in the roadway. A traffic delineator should be deformable so that if hit by a moving vehicle, it may give way without interfering with the course of the vehicle or without causing damage to the vehicle. A highway delineator should be capable of springing back to its original position immediately after being struck down by a vehicle so that it may continue to serve its purpose without continual maintenance.

Beyond the basic requirements for a traffic delineator, the cost of the traffic delineator becomes of primary concern. In a multi-lane highway, thousands upon thousands of such delineators may be used to mark the edge of the highway. Accordingly the cost is a major consideration. The total cost of a traffic delineator includes not only the initial cost of the delineator but the cost of labor to install the traffic delineator and the repair and/or replacement cost of the delineator. Accordingly, a traffic delineator should be simply and inexpensively made. It should be easily implanted in the surface where it is to be located. It should be durable and repairable, and replacement parts should be inexpensive.

Various designs of traffic delineator assemblies have been proposed which give way upon impact and spring back to an upright position.

Some configurations have employed a rigid base attached to a generally rigid delineator by a spring so that the delineator, upon impact, bends at the spring and thereafter snaps back. Such configurations are expensive, and rigid delineators may dent impacting vehicles.

A fiberglass delineator described by Schmanski in U.S. Pat. No. 4,092,081 employs sufficient longitudinal fibers that it may withstand a driving force into hard ground.

A delineator comprised of fiberglass or plastic, however, cannot be driven into harder roadway surfaces such as asphalt. As it is cheaper to drive a delineator directly into the roadway surface than to insert the delineator into a preformed hole, it would be desirable to have a flexible delineator assembly which may be driven directly into commonly used roadway surfaces.

Accordingly, it is an object to provide a highway delineator assembly which is highly visible, resiliently deformable and inexpensive both in its initial cost and in its long range use. Furthermore it is an object of the present invention to provide a traffic delineator assembly which may be driven directly into surfaces commonly used on roadway shoulders such as asphalt or compacted soil.

The above objects are achieved in the present invention by a delineator assembly which uses an anchor post which is drivable into a hard surface. A rigid pilot plate is attached to the top end of the anchor post, and a resiliently deformable delineator is attached to the pilot plate. The rigid pilot plate as well as the anchor post are driven below the surface and the pilot plate acts to pull a lower end of a flexible delineator into the surface.

FIGS. 4A–D are top plan views of various embodiments of the delineator.

Figure 5:
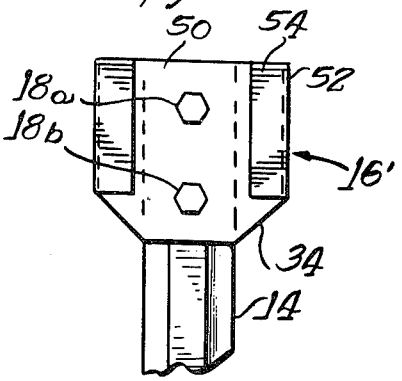

FIG. 5 is an elevation view of an alternate embodiment of the pilot plate.

Figure 6:
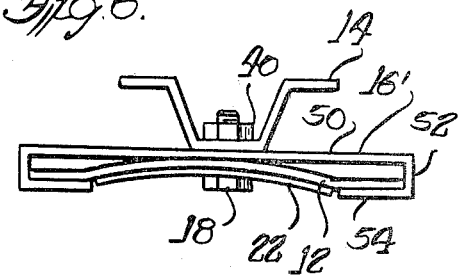

FIG. 6 is a top plan view of a traffic delineator employing the alternative embodiment of the pilot plate shown in FIG. 5.

Figure 7:
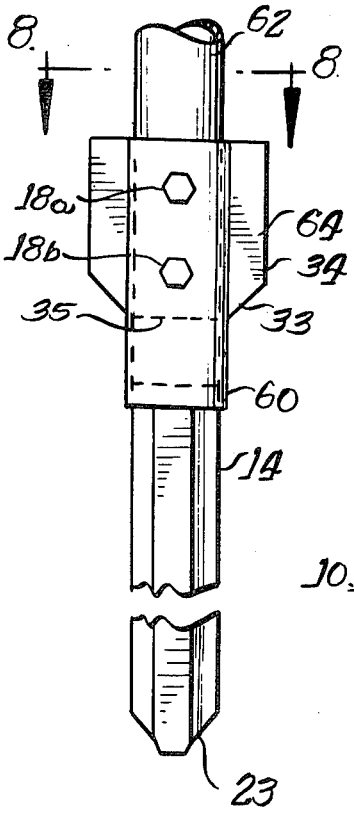

FIG. 7 is a further embodiment of the traffic delineator assembly in which the pilot plate and delineator are cylindrical.

Figure 8:
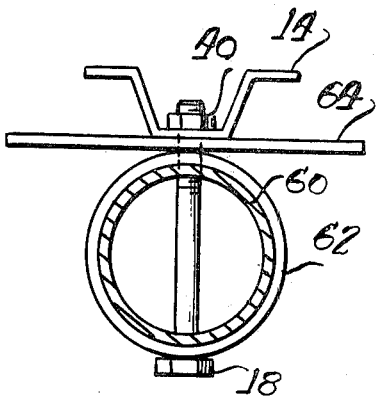

FIG. 8 is a cross sectional view of the alternative embodiment of the assembly shown in FIG. 7 taken along line 8—8.

Figure 9:
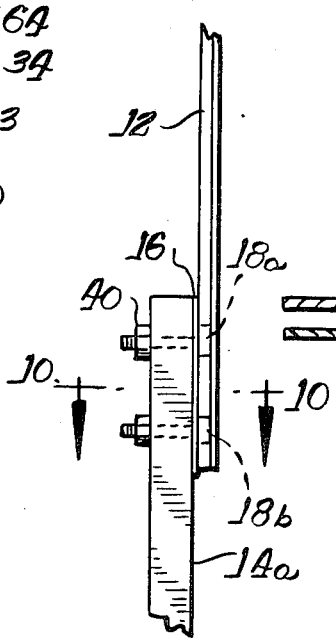

FIG. 9 is a side elevation view of an alternate embodiment of the invention which employs a wooden anchor post.

Figure 10:
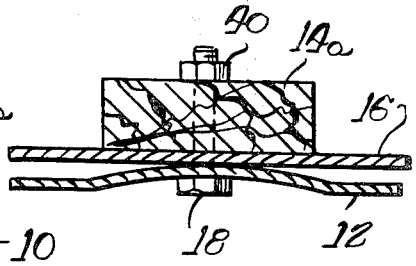

FIG. 10 is a cross sectional view of the embodiment of the delineator assembly shown in FIG. 9 taken along line 10—10.

Figure 1:
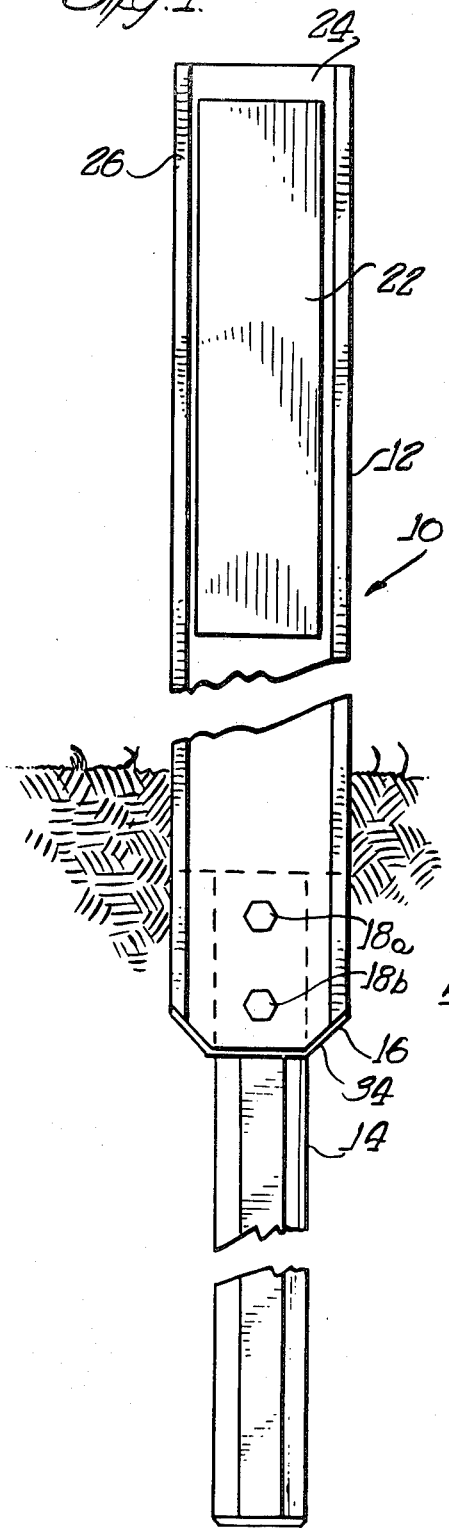
FIG. 1 is a front elevation view of a traffic delineator assembly.
Figure 2:
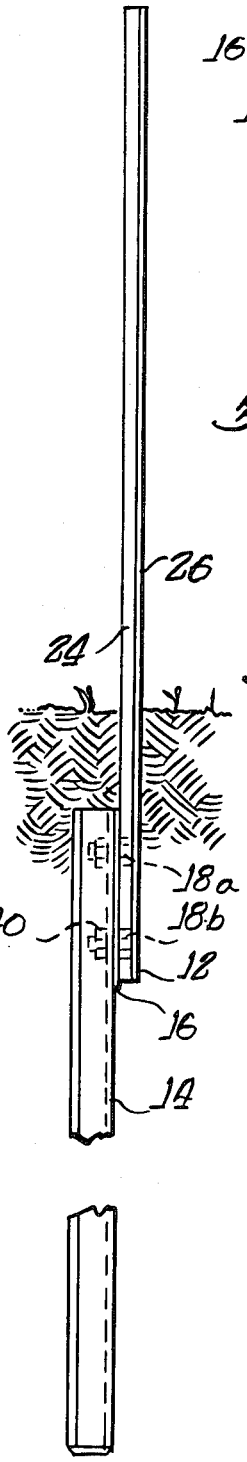
FIG. 2 is a partial side elevation view of the traffic delineator assembly shown in FIG. 1.
Figure 3:
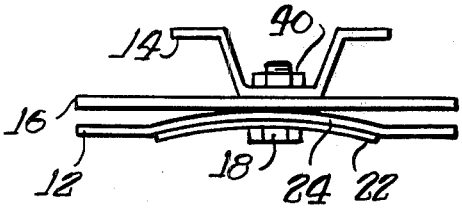
FIG. 3 is a top plan view of the traffic delineator assembly shown in FIG. 1.

In FIG. 1 is illustrated a traffic delineator assembly 10 in which a resiliently flexible delineator 12 is attached to a anchor post 14 which is driven below the surface. At the top of the anchor post 14 a pilot plate 16, generally equal in width to the delineator 12, is provided so that when the anchor post 14 and the pilot plate 16 are driven into the roadway surface, the bottom end of the delineator 12 will follow the pilot plate 16 into the surface. The delineator 12 and the pilot plate 16 are attached to the anchor post 14 by an upper **18*a* and lower 18*b* bolt. As shown in FIG. 1, a reflector 22 which may be a plastic reflector or a strip of reflecting tape is positioned at the upper end of the delineator 12. Alternatively, the entire surface of the delineator 12 facing traffic may be reflective. The delineator 12** may also be used to support a small sign, i.e. mileage marker numbers.

To aid in understanding the invention, the traffic delineator assembly will now be described in greater detail.

The anchor post 14 of the present invention is to be driven into the surface and accordingly must be sufficiently strong to be driven in such surfaces as asphalt or compacted soil. While the cross section of the anchor post 14 may be any shape, a preferred anchor post 14 is a channel-type post which provides good strength and is readily available at a reasonable cost. The anchor post 14 is preferably made of steel but may be formed from aluminum or fiberglass reinforced plastic depending on the strength requirements as dictated by the particular roadway surface. To aid in driving the anchor post 14 into the ground the lower portion 23 of the anchor post 14 may be chamfered. The anchor post 14 is of sufficient length to provide permanent stability and may be about 18 inches long.

The delineator 12 extends upward from the anchor post 14. The delineator 12 is designed to be deformable when hit by a moving vehicle, but it must be sufficiently resilient to resume an upright position immediately after the vehicle has passed over it. It also is sufficiently rigid so that it will stand upright under static conditions.

The delineator 12 may be made of thermoset plastic thermoplastics, fiberglass, rubber or combinations thereof so long as the delineator has the requisite deformable resiliency. A fiberglass delineator 12 with a least about 20% of the fiber oriented in the longitudinal direction is an especially suitable material. The choice of material will depend largely on cost. As the delineator 12 is to retain its resilient deformability under the climate conditions to which it will be subjected, local weather conditions may affect the choice of delineator material. The material is selected to be sufficiently durable to provide a long lasting delineator 12.

Figure 4A:
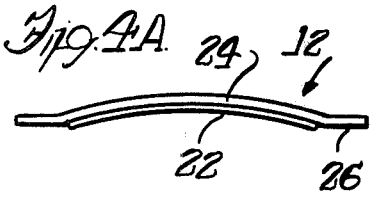

The deformable resiliency of the delineator 12 may be enhanced by the shape of the delineator 12. While the delineator 12 may be flat, other configurations provide increased resiliency and rigidity. The cross section of the delineator 12 as best seen in FIG. 4A has a major central curved panel 24 with short flat coplaner edge flanges 26 extending therefrom.

Figure 4B:
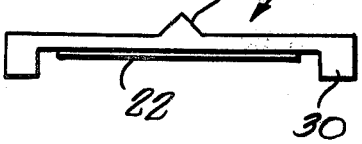
Figure 4C:
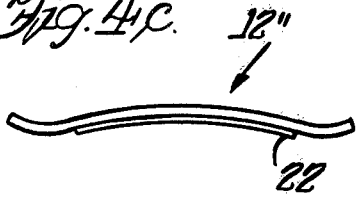
Figure 4D:
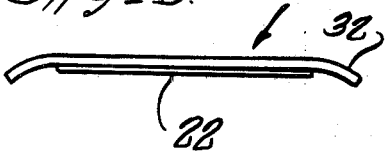

A curved profile is not unique in providing added resiliency and rigidity to the delineator 12. The generally flat delineator 12' illustrated in FIG. 4B is provided with additional resiliency and rigidity by a longitudinal rib 29 extending from one face and edge members 30 extending perpendicularly from the other face. Similarly a waved delineator 12'' as shown in FIG. 4C or a flat delineator 12''' with angled edge flanges 32 will both be more rigid and more resilient than a flat delineator.

Because the delineator 12 is made of flexible material, it cannot by itself be inserted directly into a hard surface. The pilot plate 16 which is usually wider than the anchor post 14 is provided at the top of the anchor post 14 to guide the delineator 12 into the ground. The base plate 16 is generally equal in width to the delineator 12 allowing the bottom of the delineator 12 to lie generally along the pilot plate 16 so that when the anchor post 14 and pilot plate 16 are driven below the surface, the pilot plate 16 will pull the delineator 12 along with it. The pilot plate 16 may be flat, and while as hereinabove described, the delineator 12 preferably has a non-flat profile, so long as the edges of the delineator 12 do not flare outwardly far from the pilot plate 16, the delineator 12 will follow a flat pilot plate 16 into the surface. While the pilot plate 16 could be contoured to approximate the contours of the delineator 12 this would add significant expense, and, hence, a flat pilot plate 16 is generally preferred. Preferably a chamfer 33 joins side edges 34 to the bottom edge 35 of the pilot plate 16 to aid in driving the pilot plate 16 into the ground.

The top edge of pilot plate 16 is located generally flush with the top edge of the anchor post 14 so that it is possible to apply a simultaneous driving force to the anchor post 14 and the pilot plate 16 as, for example, when the delineator assembly 10 is pounded directly into the surface with a sledgehammer.

The bolts 18 and nuts 40 which attach the delineator 12 and pilot plate 16 to the anchor post 14 are preferably a hard corrosion resistant metal so that the bolts 14 and the nuts 40 neither break when driven into the ground nor rust while in position under the ground. The bolts 18 should be no longer than necessary to bolt the delineator 12 and pilot plate 16 to the anchor post 14 so that the bolts 18 do not provide significant resistance to the driving of the anchor post 14. As the bolts 18, as hereinafter described, may need to be removed for repair of the delineator assembly 10, a bolt 18 selected to be sufficiently short will minimize damage to thread when the delineator assembly 10 is driven into a hard surface.

The holes for the bolts 18 in the delineator 12 are appropriately positioned so that when the delineator 12 is bolted to the anchor post 14 and pilot plate 16, the bottom edge 44 of the delineator 12 is located slightly above, preferably at least $\frac{1}{8}$ inch above, the bottom edge of the pilot plate 16. This allows the pilot plate 16 to cut into the surface and for the delineator 12 to follow the pilot plate 16 into the surface.

Because the pilot plate 16 and the anchor post 14 are hard metal, they must be driven below the surface so as not to damage tires of vehicles that pass thereover. Preferably the top of the anchor post 14 and pilot plate 16 are driven at least two inches below the surface of the roadway. This insures that the anchor post 14 and pilot plate 16 will not work upward above the surface of the roadway during freezing and thawing to pose a hazard to tires. Furthermore, by being countersunk into the roadway, the delineator 12 has some room to flex so that when a vehicle passes thereover, the delineator 12 is not bent along the top edge of the steel pilot plate 16 which could lead to rapid deterioration of the delineator 12.

While the material of which the delineator 12 is constructed is chosen for durability, it will, upon repeated impact, eventually be broken off. This will usually occur at the surface of the roadway. A broken delineator assembly 10 may easily be repaired. The pilot plate 16 and anchor post 14 may be pulled above the surface of the roadway, the bolts 18 removed and the broken lower end of the delineator 12 removed. The remaining piece of the delineator 12, which initially may extend approximately four feet above the surface of the roadway, is cut down about 4 to 6 inches. Appropriate holes are punched or drilled in the broken piece and the delineator 12 is reattached to the anchor post 14 and pilot plate 16. The repaired delineator assembly 10 is then driven into the surface of the roadway. In this manner, the delineator assembly 10 may be repaired several times merly by cutting back the length of the delineator 12.

While a flat pilot plate 16 is suitable for most purposes, when driving through a very hard surface, as for example, asphalt, it may be desirable to provide the flexible delineator 12 with additional support. An alternative embodiment of the pilot plate 16' as shown in FIGS. 5 and 6 provides additional support for the delineator 12 when the delineator assembly 10 is driven into the surface. The pilot plate 16' has a generally rectangular main panel 50 with chamfers 33 connecting the sides 34 and lower edge 35 to ease the pilot plate 16 into the hard surface. Side panels 52 extend from the main panel 50 of the pilot plate 16' generally orthagonal to the main panel 50. A pair of flanges 54 extend generally inward from the side panels 52 generally orthagonal thereto. The side panels 52 are spaced apart, generally equal to the width of the delineator 12. The flanges 54 are spaced from the main panel 50 so that when the curved delineator 12 is located therebetween, the flanges 54 of the pilot plate 16' support edge flanges 26 of the delineator 12 while the main panel 50 contacts the curved section 24 of the delineator 12.

In a further alternative embodiment, the delineator 60 may be a right cylindrical tube. When a tubular delineator 60 is used, its lower end is supported for driving into the ground by a length of steel tubing or pipe 62 which serves the function of the pilot plate by pulling the tubular delineator 60 into the ground.

A rigid anchor plate 64 may be provided between the anchor post 14 and the pipe 62. The anchor plate 64 used with a tubular delineator 60 may be similar in design to the flat pilot plate 16 used with an open faced delineator 12. The anchor plate 64 provides stabilization and may serve in locating a driving tool.

While the invention has been described using a channel-type anchor post 14 of a material such as steel which provides sufficient strength where the delineator assembly 10 is to be driven into such surfaces as asphalt, in certain applications, as for example, in a soft dirt shoulder of a highway, the anchor post 14*a* may be made of a softer material such as hardwood, as shown in FIG. 8. The steel pilot plate 16 and delineator 12 are bolted thereto and the wooden anchor post 14*a* is driven below the surface. While wood is cheaper it is also less durable and accordingly is best used where the delineator 12 will likely be struck relatively few times.

While the delineator assembly 10 may be pounded directly into the surface with means such as a sledgehammer, a drive means as described in co-pending application Ser. No. 101,440, Filed Dec. 10, 1979, facilitates driving either manually or with an impact type drive tool. The drive means reduces breakage of the delineator 12 which may easily occur at the top edge of the base plate 16 if the assembly 10 is pounded directly with a hammer. Furthermore, the drive means permits the post 14 and base plate 16 to be countersunk below the roadway surface.

The drive means has a lower surface for driving contact with the upper edge of the anchor post 14 and a pair of legs which depends downward therefrom to straddle the channel of the anchor post 14 and locate between the flanges of the anchor post 14 and the pilot plate (or anchor plate 64 as used with a tubular delineator 60). The upper surface of the drive means is generally flat for receiving hammer blows and contains a depression therein for insertion of an adaptor to link the drive means with an impact type drive tool.

While the invention has been described in terms of certain preferred embodiments, modifications which are obvious to one skilled in the art may be made without departing from the teachings of the present invention which is limited only according to the following claims.

What is claimed is:

1. A traffic delineator assembly comprising:

an elongated rigid anchor post having an upper end to receive blows and to be driven into a support surface such as the ground or roadway surface or the like with its upper end to be located below ground;

an elongated rigid pilot means mounted on said anchor means and adapted to be driven into the ground or roadway surface with said anchor means;

said rigid pilot means being located in a parallel vertical relationship with said anchor post and being located below the upper edge of the anchor post so as to be driven into the ground with the anchor post;

flexible delineator means mounted on said anchor means and defining a lower edge, said delineator means being located so that said lower edge follows said pilot plate means into the ground or roadway surface and being adapted to extend above the ground or roadway surface when said anchor means and pilot plate means are driven into the ground or roadway surface, said delineator means being sufficiently rigid to be unaffected by static conditions yet resiliently deformable to bend upon impact and spring back substantially to its pre-bend position and fastener means connecting the flexible delineator means to the rigid anchor post and to the rigid pilot means and to be located below ground.

2. A traffic delineator assembly as defined in claim 1 wherein said flexible delineator means comprises an elongated flexible delineator member mounted on said anchor post such that said lower edge lies generally adjacent the lower edge of said pilot plate.

* * * * *